US012660921B2

(12) United States Patent
Chen et al.

(10) Patent No.: US 12,660,921 B2
(45) Date of Patent: Jun. 23, 2026

(54) SLIDE RAIL ASSEMBLY

(71) Applicants: King Slide Works Co., Ltd., Kaohsiung City (TW); King Slide Technology Co., Ltd., Kaohsiung City (TW)

(72) Inventors: Ken-Ching Chen, Kaohsiung City (TW); Shun-Ho Yang, Kaohsiung City (TW); Tzu-Cheng Weng, Kaohsiung City (TW); Chun-Chiang Wang, Kaohsiung City (TW)

(73) Assignees: King Slide Works Co., Ltd., Kaohsiung City (TW); King Slide Technology Co., Ltd.

( * ) Notice: Subject to any disclaimer, the term of this patent is extended or adjusted under 35 U.S.C. 154(b) by 79 days.

(21) Appl. No.: 18/819,669

(22) Filed: Aug. 29, 2024

(65) Prior Publication Data

US 2025/0311847 A1 Oct. 9, 2025

(30) Foreign Application Priority Data

Apr. 3, 2024 (TW) ..... 113112932

(51) Int. Cl.
*A47B 88/407* (2017.01)
*A47B 88/43* (2017.01)

(52) U.S. Cl.
CPC ..... *A47B 88/407* (2017.01); *A47B 88/43* (2017.01)

(58) Field of Classification Search
CPC ..... A47B 88/407; A47B 88/43; A47B 96/07; A47B 96/068; A47B 88/49; A47B 2088/4235; A47B 88/423; H05K 7/1489; H05K 7/183; H05K 7/1421; H05K 7/14; H05K 5/0221
See application file for complete search history.

(56) References Cited

U.S. PATENT DOCUMENTS

| | | | | |
|---|---|---|---|---|
| 7,357,362 | B2 | 4/2008 | Yang et al. | |
| 8,353,494 | B2 * | 1/2013 | Peng | A47B 88/43 248/221.11 |
| 10,806,255 | B1 | 10/2020 | Chen et al. | |
| 10,925,398 | B2 | 2/2021 | Chen et al. | |
| 2005/0156493 | A1 * | 7/2005 | Yang | H05K 7/1489 312/334.5 |
| 2009/0114785 | A1 * | 5/2009 | Huang | A47B 88/43 248/220.31 |

(Continued)

FOREIGN PATENT DOCUMENTS

| | | | |
|---|---|---|---|
| EP | 3750446 | B1 | 1/2022 |
| EP | 3751971 | B1 | 4/2023 |

*Primary Examiner* — Hiwot E Tefera
(74) *Attorney, Agent, or Firm* — Best & Flanagan LLP

(57) ABSTRACT

A slide rail assembly includes a first rail, a first bracket device and a second bracket device. The first rail includes a first predetermined feature. The first bracket device is arranged on the first rail. The second bracket device and the first rail are movable relative to each other. The second bracket device includes a locking member having a second predetermined feature. During a relative movement between the first rail and the second bracket device, the first predetermined feature of the first rail and the second predetermined feature of the locking member are configured to abut against each other, in order to move the locking member to switch from a first state to a second state.

10 Claims, 10 Drawing Sheets

(56) References Cited

U.S. PATENT DOCUMENTS

| | | | | |
|---|---|---|---|---|
| 2017/0042328 | A1* | 2/2017 | Chen | A47B 88/43 |
| 2017/0055707 | A1* | 3/2017 | Chen | H05K 7/1489 |
| 2017/0079427 | A1* | 3/2017 | Chen | H05K 7/1489 |
| 2017/0095079 | A1* | 4/2017 | Chen | A47B 88/43 |
| 2017/0354055 | A1* | 12/2017 | Hsu | A47B 88/43 |
| 2018/0116398 | A1* | 5/2018 | Chen | H05K 7/1489 |
| 2018/0125234 | A1* | 5/2018 | Chen | A47B 88/483 |
| 2018/0168349 | A1* | 6/2018 | Chen | A47B 88/43 |
| 2018/0199713 | A1* | 7/2018 | Chen | A47B 88/49 |
| 2018/0220797 | A1* | 8/2018 | Chen | H05K 7/183 |
| 2019/0059580 | A1* | 2/2019 | Chen | A47B 57/545 |
| 2019/0142158 | A1* | 5/2019 | Chen | A47B 88/57 211/162 |
| 2019/0274427 | A1* | 9/2019 | Chen | A47B 88/43 |
| 2020/0022493 | A1* | 1/2020 | Chen | A47B 88/407 |
| 2021/0169223 | A1* | 6/2021 | Chen | A47B 96/07 |

* cited by examiner

SLIDE RAIL ASSEMBLY

BACKGROUND OF THE INVENTION

1. Field of the Invention

The present invention relates to a slide rail assembly, and more particularly, to a slide rail assembly capable of driving a locking member of a bracket device through a slide rail.

2. Description of the Prior Art

U.S. Pat. No. 7,357,362 B2 discloses a bracket positioning structure for a slide comprising a bracket and a fastening member. The bracket comprises an end plate. The fastening member is pivotally connected to the bracket, and arranged with a hook arm. The hook arm has a locking part. When mounting members (studs) on the end plate of the bracket are inserted into holes of a post of a rack, the hook arm is deflected to allow the locking part to cross an edge of the post. Thereafter, the fastening member is held in a locking state in response to an elastic force of an elastic member in order to lock the bracket to the post of the rack.

Specifically, the fastening member is required to be manually operated by a user to move the fastening member to switch from the locking state to an unlocking state to no longer lock the bracket to the post of the rack. Therefore, it is important to improve convenience for such unlocking operation.

SUMMARY OF THE INVENTION

The present invention provides a slide rail assembly capable of driving a locking member of a bracket device through a slide rail.

According to an embodiment of the present invention, a slide rail assembly comprises a first rail, a first bracket device and a second bracket device. The first rail comprises a first predetermined feature. The first bracket device is arranged on the first rail. The second bracket device is movable relative to the first rail, and the second bracket device comprises a locking member having a second predetermined feature. During a relative movement between the first rail and the second bracket device, the first predetermined feature of the first rail and the second predetermined feature of the locking member are configured to abut against each other, in order to move the locking member to switch from a first state to a second state.

According to another embodiment of the present invention, a slide rail assembly is configured to be mounted to a rack comprising a first post and a second post. The slide rail assembly comprises a first rail, a first bracket device and a second bracket device. The first rail comprises a first predetermined feature. The first bracket device is arranged on the first rail. The second bracket device and the first rail are movable relative to each other, and the second bracket device comprises a locking member having a second predetermined feature. The first bracket device is configured to detachably mount the first rail to the first post, the second bracket device is configured to detachably mount the first rail to the second post, and the locking member in a locking state is configured to lock the second bracket device to the second post. During a process of the first rail being moved relative to the second bracket device along a predetermined direction with the first bracket device being detached from the first post, the first predetermined feature of the first rail and the second predetermined feature of the locking member are configured to abut against each other, in order to move the locking member to switch from the locking state to an unlocking state to no longer lock the second bracket device to the second post.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
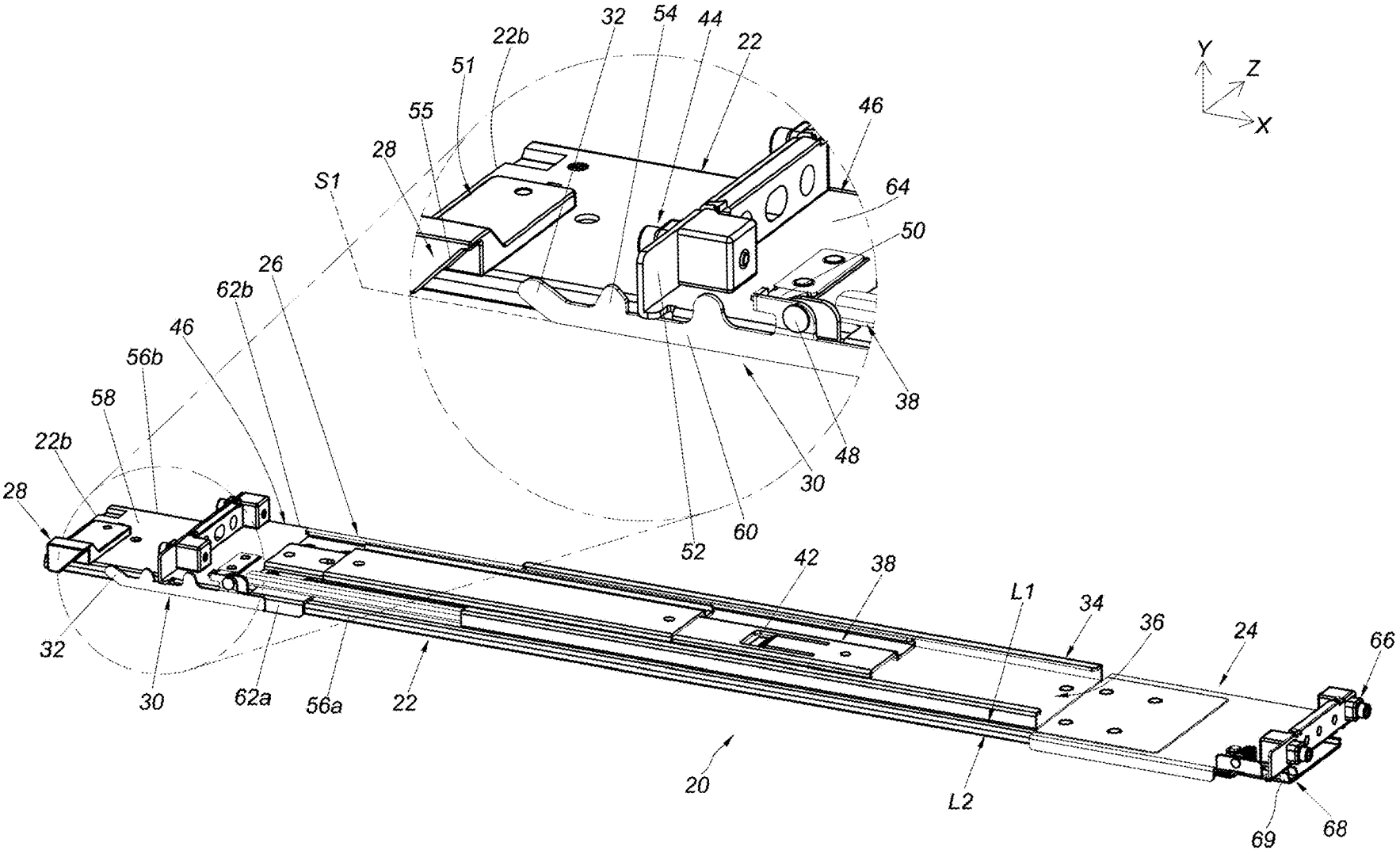
FIG. 1 is a diagram showing a slide rail assembly comprising a first rail, a first bracket device and a second bracket device according to a first embodiment of the present invention.
Figure 2:
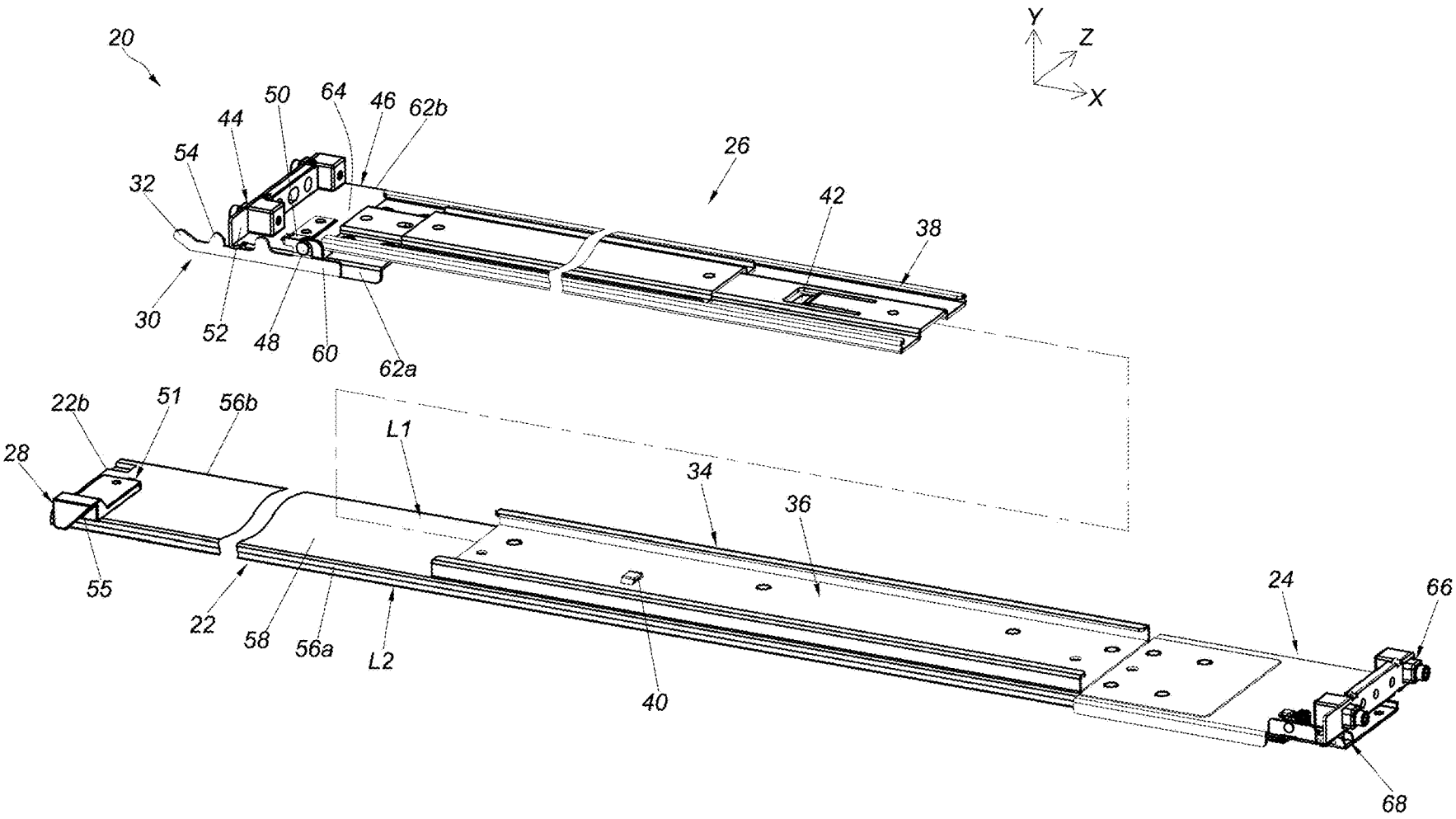
FIG. 2 is an exploded view of the slide rail assembly according to the first embodiment of the present invention.
Figure 3:
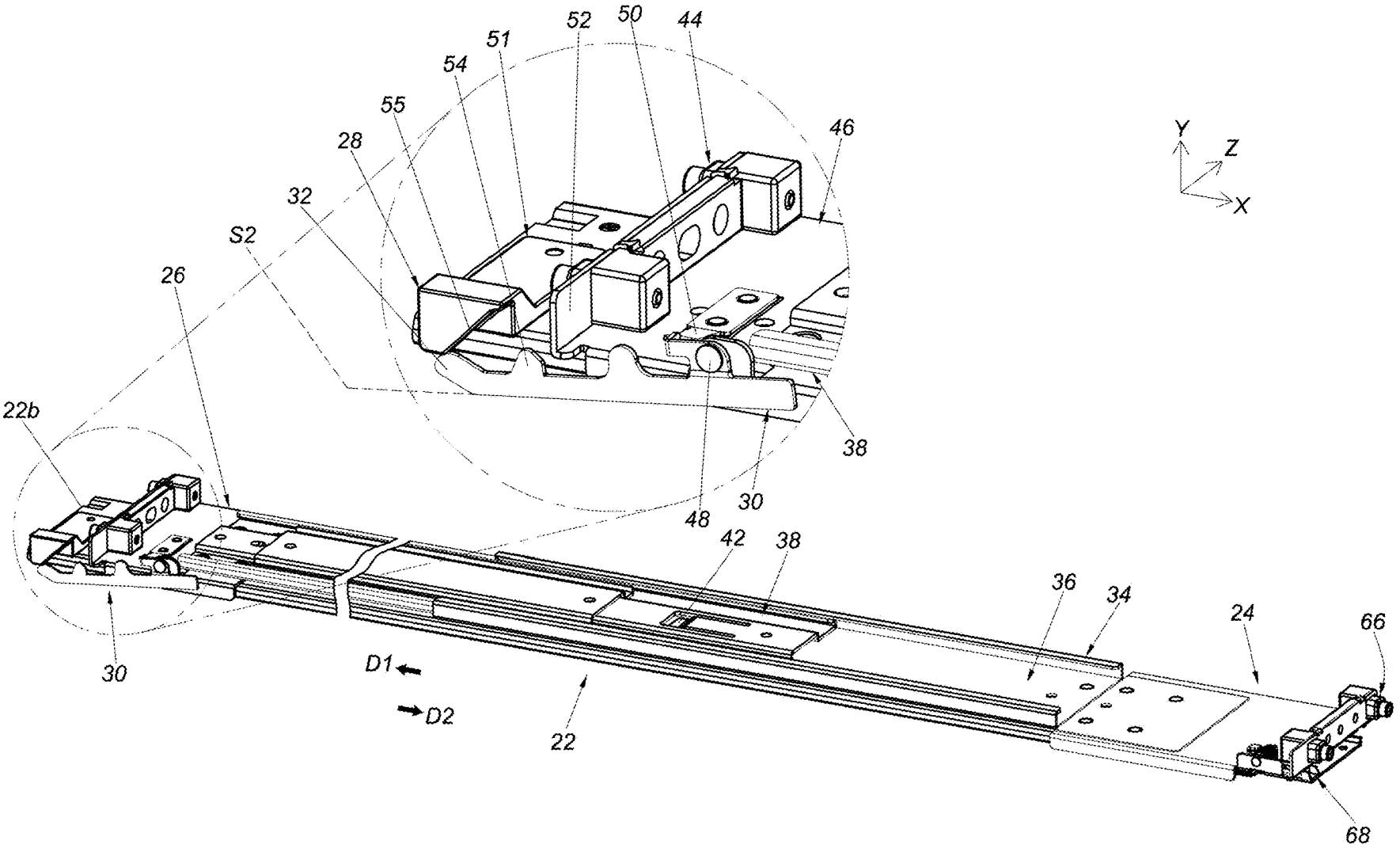
FIG. 3 is a diagram showing the second bracket device of the slide rail assembly being movable relative to the first rail according to the first embodiment of the present invention.

As shown in FIG. 1 to FIG. 3, a slide rail assembly 20 comprises a first rail 22, a first bracket device 24 and a second bracket device 26 according to a first embodiment of the present invention.

The first rail 22 comprises a first predetermined feature 28. The first bracket device 24 is arranged on the first rail 22. The second bracket device 26 and the first rail 22 are longitudinally movable relative to each other. In the figures, the X axis is a longitudinal direction (or a length direction or a moving direction of the slide rail), the Y axis is a transverse direction (or a lateral direction of the slide rail), and the Z axis is a vertical direction (or a height direction of the slide rail). The second bracket device 26 comprises a locking member 30. The locking member 30 has a second predetermined feature 32, and the second predetermined feature 32 is configured to interact with the first predetermined feature 28.

Preferably, the first rail 22 has a first end part 22*a* (please also refer to FIG. 4) and a second end part 22*b* opposite to each other, such as a front end part and a rear end part, but the present invention is limited thereto. The first bracket device 24 is arranged adjacent to (for example, fixedly connected to) the first end part 22*a* of the first rail 22. On the other hand, the second bracket device 26 is movable relative to the first rail 22 to be away from the first end part 22*a* of the first rail 22. For example, the second bracket device 26 is adjustable by a user to be moved to a position adjacent to the second end part 22*b* of the first rail 22.

Preferably, the first rail 22 has a first side L1 and a second side L2 opposite to each other, such as an outer side and an inner side, but the present invention is not limited thereto. The slide rail assembly 20 further comprises a reinforcing member 34 attached (for example, fixedly connected) to the first side L1 of the first rail 22. The reinforcing member 34 and the first rail 22 can be regarded as one piece, and the reinforcing member 34 is formed with a predetermined passage 36. On the other hand, the second bracket device 26 further comprises at least one extension frame 38 longitudinally movable relative to the first rail 22 through the predetermined passage 36 of the reinforcing member 34. A portion of the extension frame 38 is movably mounted into the predetermined passage 36. Moreover, the extension frame 38 can have one section or more than one section, but the number of the section is not limited in the present invention.

Preferably, the first rail 22 and the second bracket device 26 are respectively arranged with a first limiting part 40 and a second limiting part 42 configured to block each other, such that the first rail 22 and the second bracket devices 26 can limit each other during relative movement between the first rail 22 and the second bracket devices 26. In the present embodiment, the first limiting part 40 is arranged in the predetermined passage 36 of the reinforcing member 34 of the first rail 22, and the second limiting part 42 is arranged on the extension frame 38 of the second bracket device 26. One of the first limiting part 40 and the second limiting part 42 is a protrusion, and the other one of the first limiting part 40 and the second limiting part 42 is an elastic arm. Such configuration is well known to those skilled in the art, no further illustration is provided for simplification.

Preferably, the extension frame 38 is arranged with at least one mounting member 44, and the locking member 30 is movably mounted on the extension frame 38. In the present embodiment, an auxiliary member 46 is arranged at one end of the extension frame 38. The auxiliary member 46 is connected (for example, fixedly connected) to the extension frame 38, and the auxiliary member 46 and the extension frame 38 can be regarded as one piece. The auxiliary member 46 is located outside the predetermined passage 36 of the reinforcing member 34. The at least one mounting member 44 is arranged on the auxiliary member 46 on the extension frame 38. On the other hand, the locking member 30 is movably mounted to the extension frame 38. For example, the locking member 30 is pivoted relative to the extension frame 38. Specifically, the locking member 30 is pivotally connected to the auxiliary member 46 on the extension frame 38 through a shaft 48. The shaft 48 is arranged in a direction substantially identical to the height direction of the slide rail assembly 20 (the Z-axis direction).

Preferably, the lock 30 is movable relative to the extension frame 38 to be in one of a first state S1 (such as a locking stat as shown in FIG. 1) and a second state S2 (such as an unlocking state as shown in FIG. 3).

Preferably, the second bracket device 26 further comprises an elastic feature 50 configured to provide an elastic force to the locking member 30 in order to hold the locking member 30 in the first state S1. The elastic feature 50 can be an elastic piece, a spring or a component with elasticity. The elastic feature 50 is arranged on the auxiliary member 46.

Preferably, the auxiliary member 46 on the extension frame 38 is arranged with an end plate 52, and the end plate 52 is arranged with the mounting member 44. When the locking member 30 is in the first state S1, a locking part 54 of the locking member 30 is adjacent to the end plate 52. For example, the locking part 54 and the end plate 52 are aligned with each other along the longitudinal direction (the X-axis direction).

Preferably, one of the first predetermined feature 28 of the first rail 22 and the second predetermined feature 32 of the locking member 30 has a guiding part 55, and the guiding part 55 has an inclined surface or an arc surface. In the present embodiment, the first predetermined feature 28 of the first rail 22 has the guiding part 55. In addition, the first predetermined feature 28 can be arranged on the first rail 22 indirectly or directly. In the present embodiment, a predetermined component 51 is fixedly connected to the first rail 22, and the predetermined component 51 comprises the first predetermined feature 28. Or, in an alternative embodiment, the first predetermined feature 28 is directly formed on the first rail 22.

Preferably, the first rail 22 comprises a first wall 56*a*, a second wall 56*b* and a longitudinal wall 58 connected between the first wall 56*a* and the second wall 56*b*. The locking member 30 comprises an extension arm 60 pivotally connected to the auxiliary member 46 on the extension frame 38 through the shaft 48, and the extension arm 60 is arranged with the locking part 54 and the second predetermined feature 32. The locking part 54 is located between the second predetermined feature 32 and the shaft 48.

Preferably, the auxiliary member 46 comprises a first side part 62*a*, a second side part 62*b* and a side wall 64 connected between the first side part 62*a* and the second side part 62*b*. The first side part 62*a* and the second side part 62*b* of the auxiliary member 46 are respectively adjacent to the first wall 56*a* and the second wall 56*b* of the first rail 22.

Preferably, the extension arm 60 of the locking member 30 is located adjacent to one of the first side part 62*a* and the second side part 62*b* of the auxiliary member 46. In present embodiment, the extension arm 60 is located adjacent to the first side part 62*a* of the auxiliary member 46. In other words, the extension arm 60 is adjacent to the first wall 56*a* of the first rail 22. On the other hand, the first predetermined feature 28 of the first rail 22 is adjacent to the first wall 56*a* of the first rail 22.

As shown in FIG. 3, when the locking member 30 is in the second state S2, the locking part 54 of the locking member 30 is away from the end plate 52. For example, the locking part 54 and the end plate 52 are no longer aligned with each other along the longitudinal direction (the X-axis direction). Furthermore, the second bracket device 26 and the first rail 22 are longitudinally movable relative to each other. When the second bracket device 26 is moved along a first predetermined direction D1 relative to the first rail 22 (or, when the first rail 22 is moved along a second predetermined direction D2 opposite to the first predetermined direction D1 relative to the second bracket device 26), the first predetermined feature 28 of the first rail 22 and the second predetermined feature 32 of the locking member 30 are configured to abut against each other, in order to drive the locking member 30 to move to switch from the first state S1 to the second state S2.

In addition, the first bracket device 24 comprises at least one mounting part 66 and a movable (for example, rotatable) fastener 68.

Figure 4:
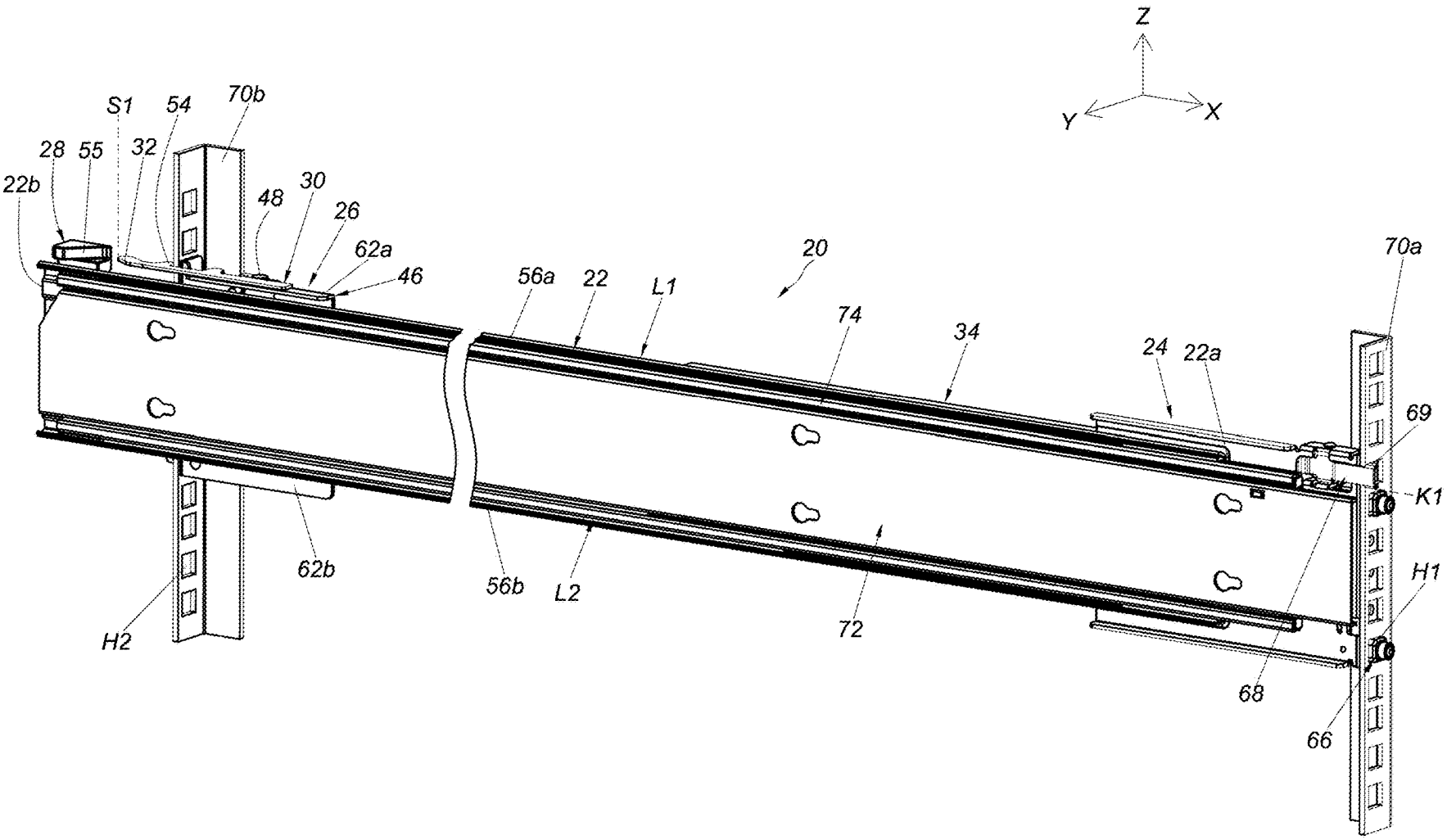
FIG. 4 is a diagram showing the slide rail assembly being mounted to a rack according to the first embodiment of the present invention.
Figure 5:
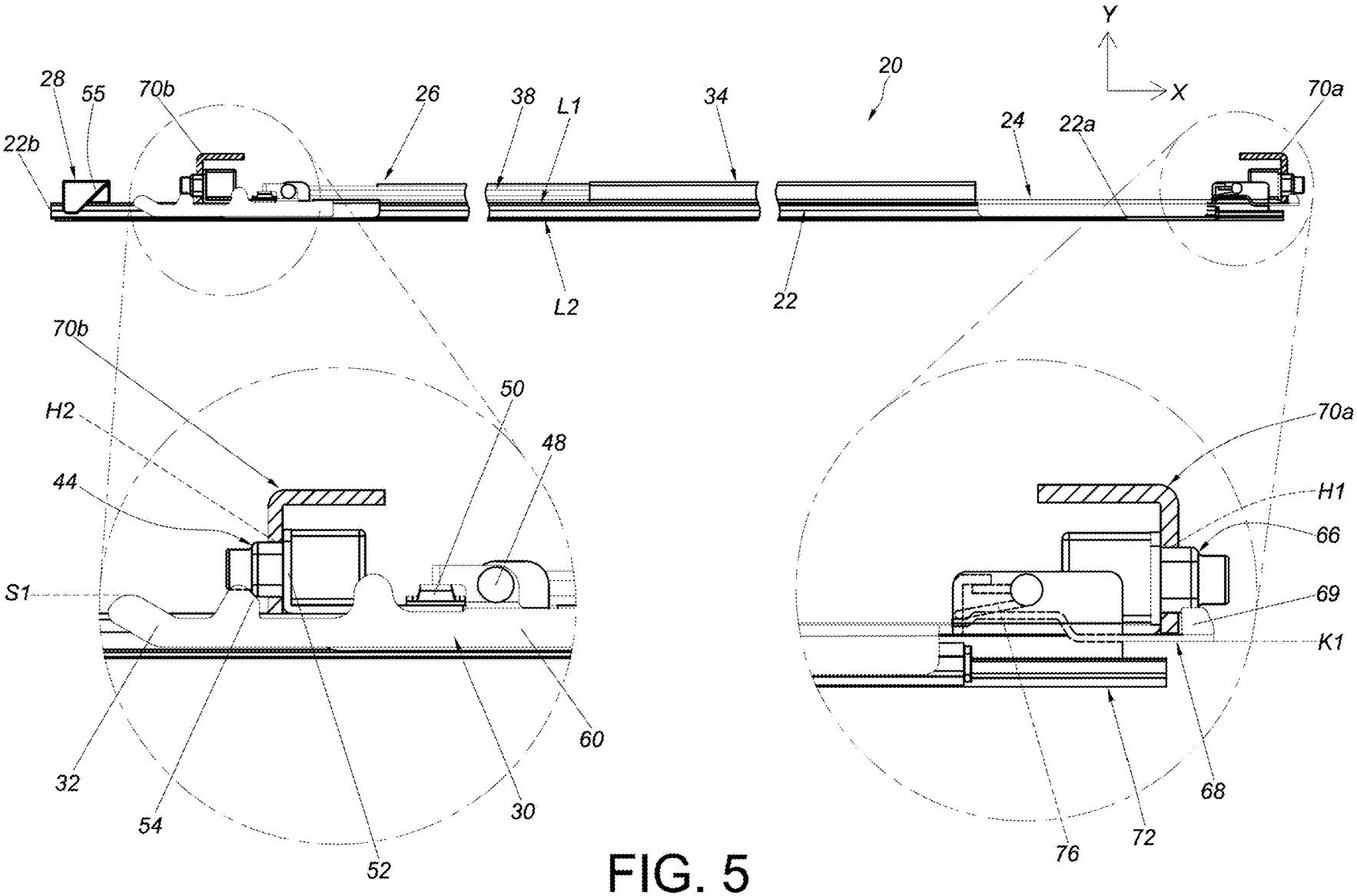
FIG. 5 is a diagram showing the slide rail assembly being mounted to the rack according to the first embodiment of the present invention.

As shown in FIG. 4 and FIG. 5, the slide rail assembly 20 is configured to be mounted to a rack. The rack comprises a first post 70*a* and a second post 70*b*, such as a front post and a rear post, but the present invention is not limited thereto. Each of the first post 70*a* and the second post 70 has a plurality of mounting features, such as a plurality of mounting holes arranged at intervals from top to bottom along the height direction (the Z-axis direction). Specifically, the first post 70*a* has a plurality of first mounting holes H1, and the second post 70*b* has a plurality of second mounting holes H2.

The first bracket device 24 is configured to detachably mount the first rail 22 to the first post 70*a*, and the second bracket device 26 is configured to detachably mount the first rail 22 to the second post 70*b*. Specifically, the mounting part 66 of the first bracket device 24 is configured to be mounted to the first mounting hole H1 of the first post 70*a*, and the fastener 68 is configured to be held in an engaging state K1 (as shown in FIG. 5) in response to an elastic force of a return elastic member 76, such that a fastening part 69 of the fastener 68 is configured to lock the first bracket device 24 to the first post 70*a*. On the other hand, the mounting member 44 of the second bracket device 26 is configured to be mounted to the second mounting hole H2 of the second post 70*b*, and the locking member 30 is configured to be held in the first state S1 in response to the elastic force of the elastic feature 50, such that the lock part 54 of the locking member 30 is configured to lock the second bracket device 26 to the second post 70*b*. According to such configuration, the slide rail assembly 20 is mounted to the rack.

Preferably, the slide rail assembly 20 further comprises a second rail 72 and a third rail 74 located at the second side L2 of the first rail 22 and movable relative to the first rail 22. The third rail 74 is movably mounted between the first rail 22 and the second rail 72 (as shown in FIG. 4). The second rail 72 is configured to carry an object (such as an electronic device or a drawer or the like).

Preferably, the second end part 22*b* of the first rail 22 is extended beyond the locking member 30 (or the second post 70*b*) by a predetermined distance, and the first predetermined feature 28 is located adjacent to the second end part 22*b* of the first rail 22.

Figure 6:
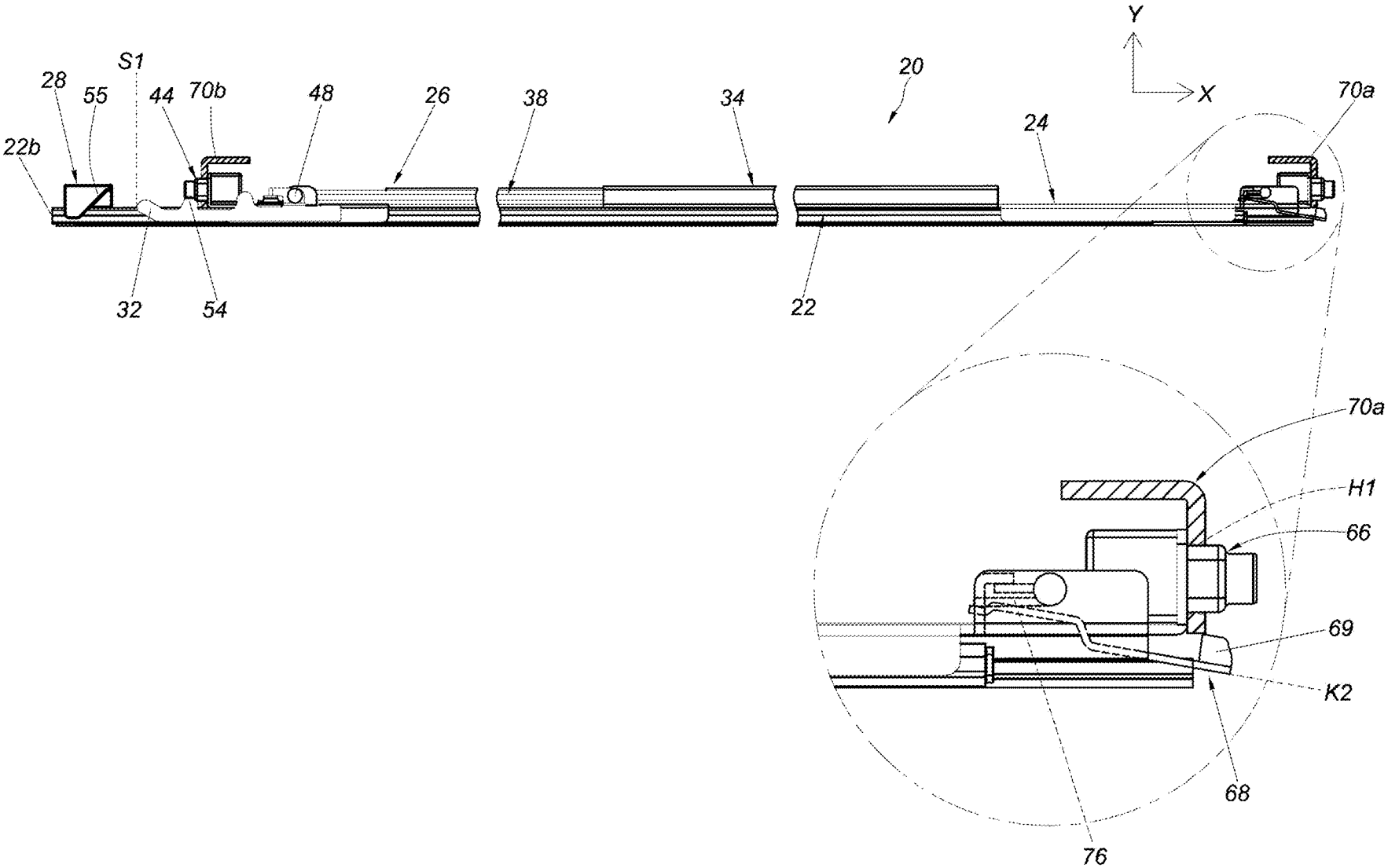
FIG. 6 is a diagram showing a fastener of the first bracket device of the slide rail assembly being disengaged from a first post of the rack according to the first embodiment of the present invention.
Figure 7:
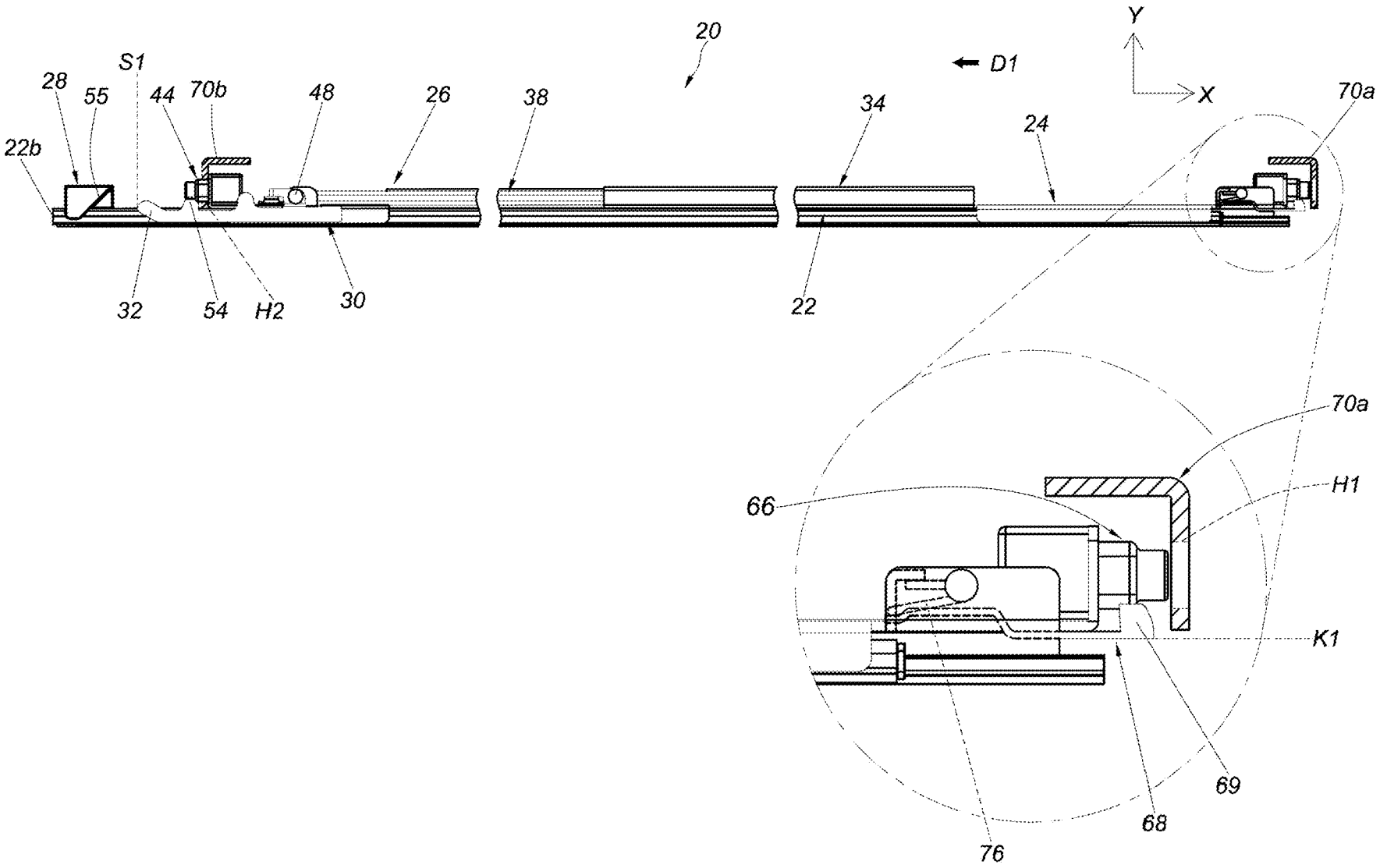
FIG. 7 is a diagram showing the first bracket device of the slide rail assembly being detached from the first post according to the first embodiment of the present invention.
Figure 8:
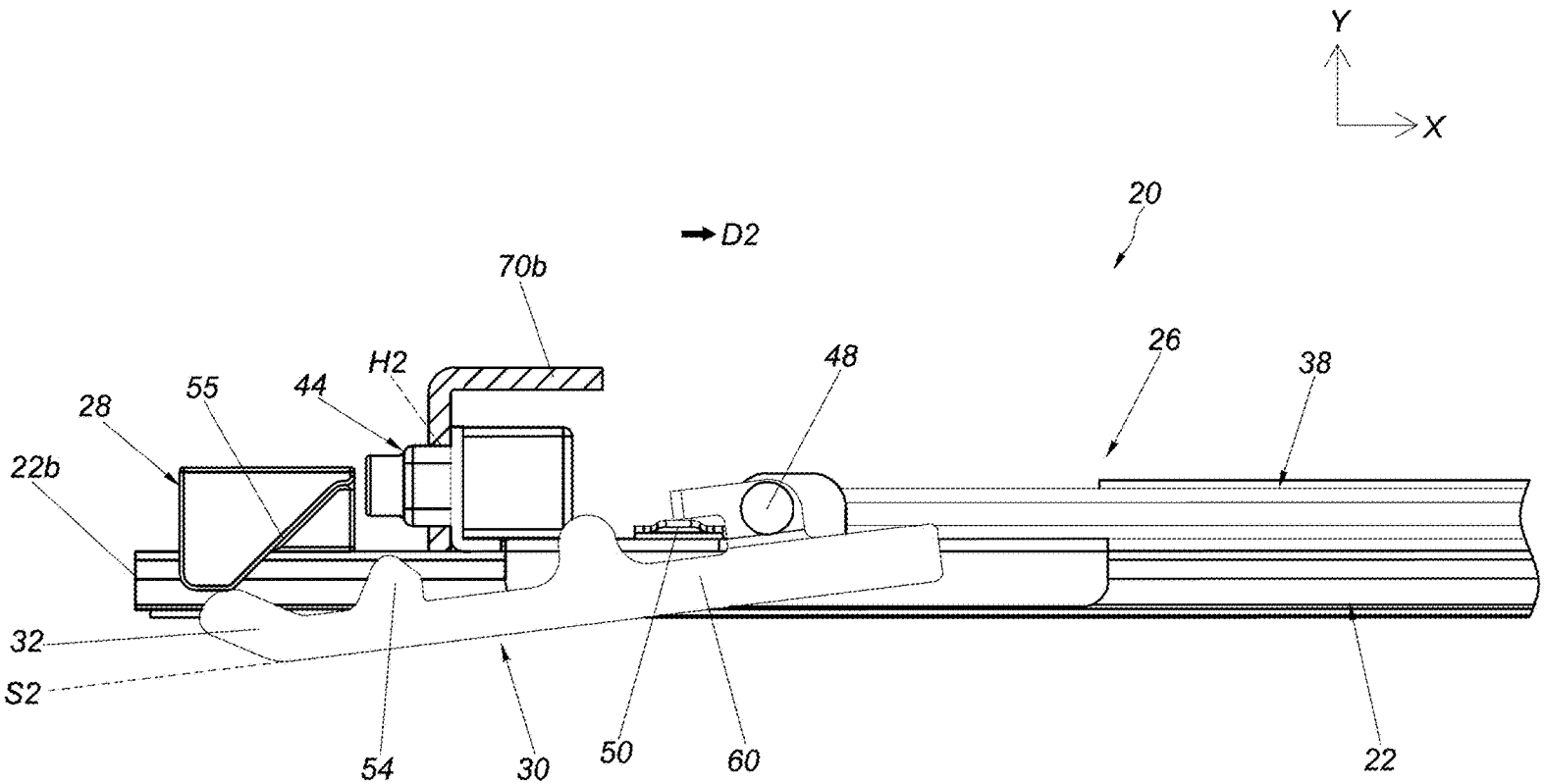
FIG. 8 is a diagram showing a locking member of the second bracket device of the slide rail assembly being disengaged from a second post of the rack according to the first embodiment of the present invention.

As shown in FIG. 6 to FIG. 8, when the user is going to detach the slide rail assembly 20 from the rack, the user needs to detach the first bracket device 24 from the first post 70*a* (as shown in FIG. 7), and detach the second bracket device 26 from the second post 70*b* (shown in FIG. 8).

For example, the user (alone) can stand at a position near the first post 70*a* of the rack (such as a position in front of the first post 70*a*), and apply a predetermined force to overcome the elastic force of the return elastic member 76, such that the fastener 68 is moved to switch from the engaging state K1 to a disengaging state K2, and the fastening part 69 of the fastener 68 no longer locks the first bracket device 24 to the first post 70*a* (as shown in FIG. 6). Thereafter, the user can apply a first operating force along the first predetermined direction D1 to the first bracket device 24 and/or the first rail 22 in order to detach the mounting part 66 of the first bracket device 24 from the first mounting hole H1 of the first post 70*a*. As such, the first bracket device 24 is detached from the first post 70*a* (as shown in FIG. 7). Moreover, once the first bracket device 24 is detached from the first post 70*a*, the fastener 68 is configured to return to the engaging state K1 (as shown in FIG. 7) from the disengaging state K2 (as shown in FIG. 6) in response to the elastic force of the return elastic member 76.

During a process of the first rail 22 being moved along a predetermined direction (such as the second predetermined direction D2) relative to the second bracket device 26 with the first bracket device 24 being detached from the first post 70*a*, the first predetermined feature 28 of the first rail 22 and the second predetermined feature 32 of the locking member 30 are configured to abut against each other, in order to drive the locking member 30 of the second bracket device 26 to move to switch from the first state S1 to the second state S2, such that the locking part 54 no longer locks the second bracket device 26 to the second post 70*b* (as shown in FIG. 8).

For example, when the first bracket device 24 is detached from the first post 70*a*, the user (alone) standing at the position near the first post 70*a* of the rack can hold the first rail (and/or the first bracket device 24) and apply a second operating force along the second predetermined direction D2, such that the first rail 22 is moved along the second predetermined direction D2 relative to the second bracket device 26. During such process, the first predetermined feature 28 of the first rail 22 and the second predetermined feature 32 of the locking member 30 are configured to abut against each other to overcome the elastic force of the elastic feature 50 in order to drive the locking member 30 of the second bracket device 26 to move to switch from the first state S1 to the second state S2, such that the locking part 54 no longer locks the second bracket device 26 to the second post 70*b*. Thereafter, the entire slide rail assembly 20 is movable along the second predetermined direction D2, such that the mounting member 44 of the second bracket device 26 can be detached from the second mounting hole H2 of the second post 70*b*. Accordingly, the second bracket device 26 can be detached from the second post 70*b*, such that the slide rail assembly 20 can be detached from the rack completely.

Figure 9:
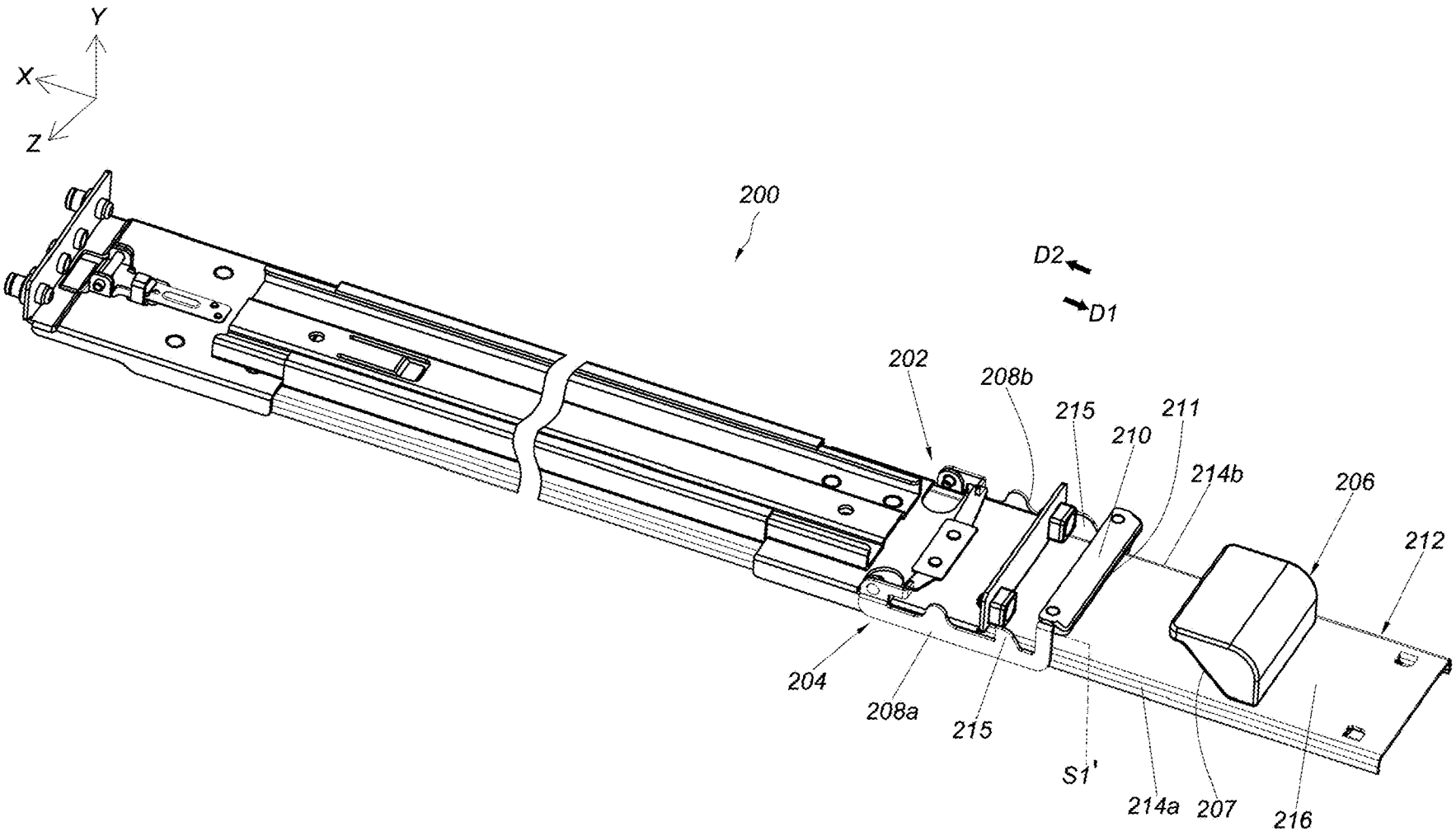
FIG. 9 is a diagram showing a slide rail assembly according to a second embodiment of the present invention.
Figure 10:
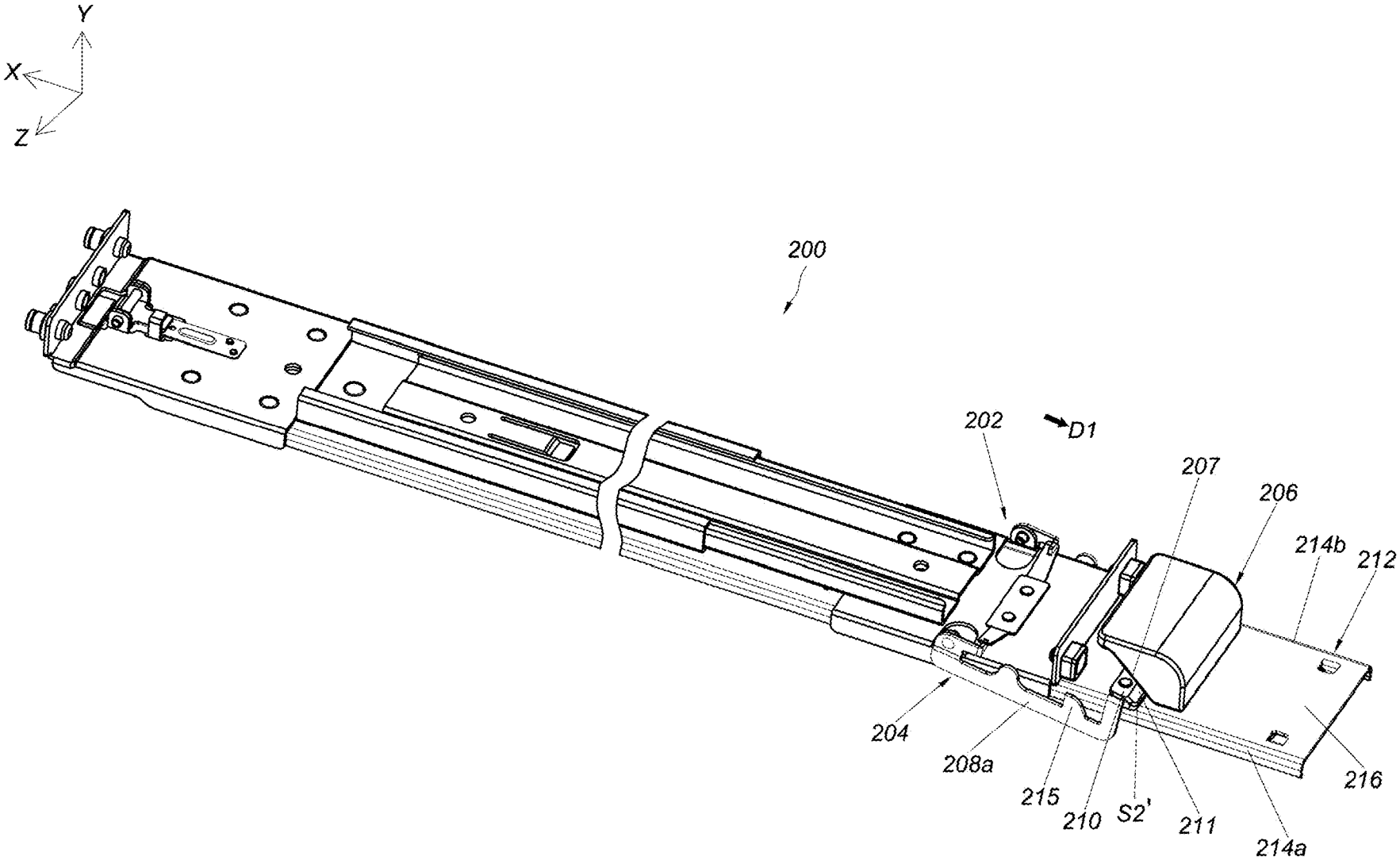
FIG. 10 is a diagram showing a second bracket device of the slide rail assembly being movable relative to a first rail according to the second embodiment of the present invention.

FIG. 9 and FIG. 10 show a slide rail assembly 200 according to a second embodiment of the present invention. In the second embodiment, structural configuration of a locking member 204 of a second bracket device 202 and a position of a first predetermined feature 206 are different from those in the first embodiment.

Furthermore, the locking member 204 comprises a first extension arm 208*a*, a second extension arm 208*b* and an operating part 210 connected between the first extension arm 208*a* and the second extension arm 208*b*. The operating part 210 comprises a second predetermined feature 211. The first extension arm 208*a* and the second extension arm 208*b* are respectively adjacent to a first wall 214*a* and a second wall 214*b* of the first rail 212. The first extension arm 208*a* and the second extension arm 208*b* have substantially identical structural configuration. For example, each of the first extension arm 208*a* and the second extension arm 208*b* comprises a locking part 215. On the other hand, the first predetermined feature 206 is arranged on a longitudinal wall 216 of the first rail 212 (as shown in FIG. 9).

When the second bracket device 202 is moved along the first predetermined direction D1 relative to the first rail 212 (or, when the first rail 212 is moved along the second predetermined direction D2 relative to the second bracket device 202), the first predetermined feature 206 (a guiding part 207 of the first predetermined feature 206) of the first rail 212 and the second predetermined feature 211 of the locking member 204 are configured to abut against each other, in order to drive the locking member 204 to move to switch from a first state S1' (such as a locking stat as shown in FIG. 9) to a second state S2' (such as an unlocking stat as shown in FIG. 10).

Therefore, the slide rail assembly (20, 200) according to the embodiment of the present invention has the following technical features: during the relative movement between the first rail (22, 212) and the second bracket device (26, 202), the locking member (30, 204) is configured to be driven to switch from the first state (S1, S1') to the second state (S2, S2'), such that the user does not need to manually operate the locking member (30, 204), so as to improve convenience for unlocking operation. Furthermore, the locking member (30, 204) can be driven to switch from the locking state to the unlocking state through moving the first rail (22, 212) relative to the second bracket device (26, 202), so as to facilitate the user to detach the slide rail assembly (20, 200) from the rack.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail comprising a first predetermined feature;

a first bracket device arranged on the first rail; and a second bracket device movable relative to the first rail, the second bracket device comprising a locking member having a second predetermined feature;

wherein during a relative movement between the first rail and the second bracket device, the first predetermined feature of the first rail and the second predetermined feature of the locking member are configured to abut against each other, in order to move the locking member to switch from a locking state to an unlocking state;

wherein the first rail has a first end part and a second end part opposite to each other; wherein the first bracket device is arranged adjacent to the first end part, and the second bracket device is movable relative to the first rail to be away from the first end part;

wherein the first rail has a first side and a second side opposite to each other; wherein the slide rail assembly further comprises a reinforcing member attached to the first side of the first rail, and the reinforcing member is formed with a predetermined passage; wherein the second bracket device further comprises an extension frame movably mounted to the predetermined passage of the reinforcing member to be movable relative to the first rail along a longitudinal direction of the slide rail assembly; wherein the extension frame is arranged with an end plate, and the end plate is arranged with at least one mounting member, the locking member is pivotally connected to the extension frame through a shaft arranged in a height direction of the slide rail assembly to be rotatable relative to the extension frame around the shaft; wherein when the locking member is in the locking state, a locking part of the locking member is adjacent to the end plate with the locking member not being pressed by the first rail along a transverse direction of the slide rail assembly; wherein when the locking member is in the unlocking state, the locking part of the locking member is away from the end plate with the first predetermined feature of the first rail pressing the second predetermined feature of the locking member along the transverse direction of the slide rail assembly.

2. The slide rail assembly of claim 1, wherein one of the first predetermined feature of the first rail and the second predetermined feature of the locking member has a guiding part.

3. The slide rail assembly of claim 1, wherein the second bracket device further comprises an elastic feature configured to provide an elastic force to the locking member.

4. The slide rail assembly of claim 1, wherein the first rail comprises a first wall, a second wall and a longitudinal wall connected between the first wall and the second wall; wherein the first predetermined feature is adjacent to the first wall of the first rail.

5. The slide rail assembly of claim 1, wherein the first rail comprises a first wall, a second wall and a longitudinal wall connected between the first wall and the second wall; wherein the locking member comprises a first extension arm, a second extension arm and an operating part connected between the first extension arm and the second extension arm, and the operating part comprises the second predetermined feature; wherein the first extension arm and the second extension arm are adjacent to the first wall and the second wall respectively; wherein the first predetermined feature is arranged on the longitudinal wall of the first rail.

6. A slide rail assembly, configured to be mounted to a rack comprising a first post and a second post, the slide rail assembly comprising:

a first rail comprising a first predetermined feature;

a first bracket device arranged on the first rail; and a second bracket device, wherein the second bracket device and the first rail are movable relative to each other, the second bracket device comprises a locking member having a second predetermined feature;

wherein the first bracket device is configured to detachably mount the first rail to the first post, the second bracket device is configured to detachably mount the first rail to the second post, and the locking member in a locking state is configured to lock the second bracket device to the second post;

wherein during a process of the first rail being moved relative to the second bracket device along a predetermined direction with the first bracket device being detached from the first post, the first predetermined feature of the first rail and the second predetermined feature of the locking member are configured to abut against each other, in order to move the locking member to switch from the locking state to an unlocking state to no longer lock the second bracket device to the second post;

wherein the first rail has a first end part and a second end part opposite to each other; wherein the first bracket device is arranged adjacent to the first end part, and the second bracket device is movable relative to the first rail to be away from the first end part;

wherein the first rail has a first side and a second side opposite to each other; wherein the slide rail assembly further comprises a reinforcing member attached to the first side of the first rail, and the reinforcing member is formed with a predetermined passage; wherein the second bracket device further comprises an extension frame movably mounted to the predetermined passage of the reinforcing member to be movable relative to the first rail along a longitudinal direction of the slide rail assembly; wherein the extension frame is arranged with an end plate, and the end plate is arranged with a mounting member configured to be mounted to a mounting hole of the second post; wherein the locking member is pivotally connected to the extension frame through a shaft arranged in a height direction of the slide rail assembly to be rotatable relative to the extension frame around the shaft; wherein when the locking member is in the locking state, a locking part of the locking member is adjacent to the end plate with the locking member not being pressed by the first rail along a transverse direction of the slide rail assembly; wherein when the locking member is in the unlocking state, the locking part of the locking member is away from the end plate with the first predetermined feature of the first rail pressing the second predetermined feature of the locking member along the transverse direction of the slide rail assembly.

7. The slide rail assembly of claim 6, wherein one of the first predetermined feature of the first rail and the second predetermined feature of the locking member has a guiding part.

8. The slide rail assembly of claim 6, wherein the second bracket device further comprises an elastic feature configured to provide an elastic force to the locking member.

9. The slide rail assembly of claim 8, wherein the first bracket device comprises a mounting part configured to be mounted to a mounting hole of the first post.

10. The slide rail assembly of claim 8, further comprising a second rail located at the second side of the first rail and movable relative to the first rail.

* * * * *